US009273405B1

(12) United States Patent
Yan et al.

(10) Patent No.: US 9,273,405 B1
(45) Date of Patent: Mar. 1, 2016

(54) ELECTROLYSIS DEVICE FOR CHLORINE PRODUCTION

(71) Applicant: University of Delaware, Newark, DE (US)

(72) Inventors: Yushan Yan, Newark, DE (US); Yun Zhao, Newark, DE (US)

(73) Assignee: University of Delaware, Newark, DE (US)

( * ) Notice: Subject to any disclaimer, the term of this patent is extended or adjusted under 35 U.S.C. 154(b) by 0 days.

(21) Appl. No.: 14/549,132

(22) Filed: Nov. 20, 2014

(51) Int. Cl.
*C25B 5/00* (2006.01)
*C25B 1/26* (2006.01)
*C25B 9/08* (2006.01)

(52) U.S. Cl.
CPC ... *C25B 5/00* (2013.01); *C25B 1/26* (2013.01); *C25B 9/08* (2013.01)

(58) Field of Classification Search
None
See application file for complete search history.

(56) References Cited

U.S. PATENT DOCUMENTS

| | | | | | |
|---|---|---|---|---|---|
| 3,542,508 | A * | 11/1970 | Acres et al. | 423/138 |
| 3,956,463 | A * | 5/1976 | Winn, Jr. | 423/300 |
| 4,370,392 | A * | 1/1983 | Savinell et al. | 429/109 |
| 5,411,641 | A * | 5/1995 | Trainham et al. | 205/618 |
| 5,770,033 | A * | 6/1998 | Murphy et al. | 205/464 |
| 6,605,381 | B1 * | 8/2003 | Rosenmayer | H01M 8/0234 29/623.1 |
| 2004/0074780 | A1 * | 4/2004 | Twardowski et al. | 205/618 |
| 2005/0164063 | A1 * | 7/2005 | Wariishi | C08L 83/14 429/483 |
| 2006/0251959 | A1 * | 11/2006 | Karamanev | 429/101 |

FOREIGN PATENT DOCUMENTS

WO WO 2014/060417 A1 * 4/2014 ..... C25B 1/02

OTHER PUBLICATIONS

Heijne et al, A Bipolar Membrane Combined with Ferric Iron Reduction as an Efficient Cathode System in Microbial Fuel Cells, Environmental Science & Technology, vol. 40, No. 17, pp. 5200-5205 Jul. 2006.*

Liu et al, Water and methanol crossover in direct methanol fuel cells-Effect of anode diffusion media, Electrochemica Acta, vol. 53, No. 17, Jul. 2008, pp. 5517-5522.*

Anson, F. C., "Exchange Current Densities for Fe(II)-Fe(III) Solutions in Sulfuric Acid and Perchloric Acid," Analytical Chemistry, Jun. 1961, pp. 939-942, vol. 33, No. 7.

Eames, D. J., et al., "Electrochemical Conversion of Anhydrous HCl to Cl2 Using a Solid-Polymer-Electrolyte Electrolysis Cell," Journal of the Electrochemical Society, Nov. 1995, pp. 3619-3625, vol. 142, No. 11.

(Continued)

*Primary Examiner* — Harry D Wilkins, III
(74) *Attorney, Agent, or Firm* — Senniger Powers LLP

(57) ABSTRACT

The present invention generally relates to cathodes used to produce chlorine gas from gaseous hydrogen chloride. The cathode comprises a cathode electrolyte comprising Fe(II) compounds and Fe(III) compounds in contact with an electron conductor. A reactor comprises a reactor solution comprising an oxidant in fluid contact with the cathode electrolyte. The fluid contact of the reactor solution with the cathode electrolyte allows the cathode electrolyte rich in Fe(II) compounds to be transferred to the reactor and combined with the reactor solution and the reactor solution rich in Fe(III) compounds to be transferred from the reactor to the cathode electrolyte after the oxidant of the reactor solution reacts with the electrolyte rich in Fe(II) compounds to form the reactor solution rich in Fe(III) compounds.

21 Claims, 17 Drawing Sheets

(56) References Cited

OTHER PUBLICATIONS

Fatih, K., et al., "Advancements in the Direct Hydrogen Redox Fuel Cell," Electrochemical and Solid-State Letters, 2008, pp. B11-B15, vol. 11, No. 2.
Gulla, A. F., et al., "Carbon-Supported Low-Loading Rhodium Sulfide Electrocatalysts for Oxygen Depolarized Cathode Applications," Applied Catalysis A: General, 2007, pp. 227-235, vol. 326.
Jin, C., et al., "Polythiophene-Assisted Vapor Phase Synthesis of Carbon Nanotube-Supported Rhodium Sulfide as Oxygen Reduction Catalyst for HCl Electrolysis," ChemSusChem, 2011, pp. 927-930, vol. 4, No. 7.
Maljusch, A., et al., "Pt—Ag Catalysts as Cathode Material for Oxygen-Depolarized Electrodes in Hydrochloric Acid Electrolysis," Analytical Chemistry, Mar. 2010, pp. 1890-1896, vol. 82, No. 5.
Martinez, I. G., et al., "Analysis of a Novel Chlorine Recycling Process Based on Anhydrous HCl Oxidation," Electrochimica Acta, 2014, pp. 387-394, vol. 123.
Mortensen, M., et al., "A Two-Stage Cyclic Fluidized Bed Process for Converting Hydrogen Chloride to Chlorine," Chemical Engineering Science, 1996, pp. 2031-2039, vol. 51, No. 10.
Moussallem, I., et al., "Chlor-Alkali Electrolysis with Oxygen Depolarized Cathodes: History, Present Status and Future Prospects," Journal of Applied Electrochemistry, Sep. 2008, pp. 1177-1194, vol. 38, No. 9.
Paulus, U. A. et al., "Oxygen Reduction on a High-Surface Area Pt/Vulcan Carbon Catalyst: A Thin-Film Rotating Ring-Disk Electrode Study," Journal of Electroanalytical Chemistry, 2001, pp. 134-145, vol. 495.
Perez-Ramirez, J., et al., "Sustainable Chlorine Recycling via Catalysed HCl Oxidation: From Fundamentals to Implementation," Energy & Environmental Science, 2011, pp. 4786-4799, vol. 4.
Posner, A. M., "The Kinetics of Autoxidation of Ferrous Ions in Concentrated HCl Solutions," Transactions of the Faraday Society, 1953, pp. 382-388, vol. 49.
Pupkevich, V., et al., "The Effect of Activation on the Electrochemical Behaviour of Graphite Felt Towards the Fe3+/Fe2+ Redox Electrode Reaction," Electrochemistry Communications, 2007, pp. 1924-1930, vol. 9.
Ziegelbauer, J. M., et al., "Chalcogenide Electrocatalysts for Oxygen-Depolarized Aqueous Hydrochloric Acid Electrolysis," Electrochimica Acta, 2007, pp. 6282-6294, vol. 52.

* cited by examiner

ELECTROLYSIS DEVICE FOR CHLORINE PRODUCTION

FIELD OF THE INVENTION

The present invention generally relates to cathodes and electrolysis devices used to produce chlorine gas from gaseous hydrogen chloride.

BACKGROUND OF THE INVENTION

Chlorine is an important bulk product in the chemical industry (Moussallem, I., et al., *J Appl Electrochem* (2008) 38 (9), 1177). It is used to manufacture isocyanates, and chlorinated/fluorinated hydrocarbons; hydrogen chloride is a by-product of these processes. Since the hydrogen chloride market is oversaturated and there is significant demand for chlorine, chlorine recycling from hydrogen chloride becomes increasingly more desirable. A number of commercial processes have been developed to convert hydrogen chloride into usable chlorine gas.

Two different processes are used to convert aqueous hydrochloric acid or gaseous hydrogen chloride into chlorine: a thermal catalytic oxidation and an electrochemical process. Commercial catalytic oxidation processes are based on the Deacon reaction and known as the "Shell-Chlor", the "Kel-Chlor", and the "MT-Chlor" processes (Wattimena, F., and Sachtler, W. M. H., Catalyst Research for the Shell Chlorine Process. In *Studies in Surface Science and Catalysis*, Seiyama, T., and Tanabe, K., (eds.) Elsevier (1981), Vol. 7, Part B, pp 816). The Deacon process uses a fixed bed or fluidized bed containing catalysts (Perez-Ramirez, J., et al., *Energy and Environmental Science* (2011) 4 (12), 4786). Various catalysts such as copper, ruthenium oxide, rare earth compounds, various forms of nitrogen oxide, and chromium oxide have been developed by different companies for the reaction of equation (1).

$$4\,HCl + O_2 \xrightarrow{\text{Catalyst}} 2Cl_2 + 2H_2O \tag{1}$$

Although a low temperature Deacon process is relatively energy-efficient, it has the disadvantages of low conversion, high capital cost, corrosion, high catalyst cost, and short catalyst lifetime (Mortensen, M., et al., *Chemical Engineering Science* (1996) 51 (10), 2031). Moreover, these Deacon processes are operated at elevated pressures and temperatures of 250° C. and above and are most economical at large scale.

There are two electrochemical processes for converting hydrochloric acid or gaseous hydrogen chloride into chlorine (Kuwertz, R., et al., *Electrochemistry Communications* (2013) 34, 320; Martinez, I. G., et al., *Electrochimica Acta* (2014) 123 (0), 387). In the first process, a hydrogen evolution reaction (HER) is used at the cathode, and in the overall reaction, hydrogen chloride is split into chlorine and hydrogen (equation 2). In the second process, an oxygen depolarized cathode (ODC) is used, and in the overall reaction, the oxidation of hydrogen chloride generates chlorine and water (equation 3).

$$HCl—Cl_2+H_2 \tag{2}$$

$$4HCl+O_2—2Cl_2+2H_2O \tag{3}$$

The reversible cell voltage theoretically can be significantly lower when an ODC is used instead of a HER at the cathode.

The electrochemical conversion processes can also be distinguished according to whether aqueous hydrochloric acid or gaseous hydrogen chloride is used as shown in Table 1.

TABLE 1

Comparison of known electrolysis processes for chlorine production from HCl

| | Bayer-Uhde-Hoechst Process | Bayer-Uhdenora Process | Dupont-Denora Process |
|---|---|---|---|
| Current density ($kA/m^2$) | 4 | 4 | 10 |
| Unit-cell voltage (V) | 2 | 1.35 | 1.7 |
| Energy consumption ($kWh/tCl_2$) | 1,500 | 1020 | 1,250 |
| Anode | Graphite | $Ti/RuO_2$ (DSA) | $RuO_2$ |
| HCl-form | Dissolved in water | Dissolved in water | Gaseous |
| Cathode | Graphite | $Rh_xS_y$ | Pt/C |
| Cathode reaction | HER | ODC | HER |
| Separator | PVC | Nafion | Nafion |
| Temperature (° C.) | 60-90° C. | 60° C. | 80° C. |

HER: Hydrogen evolution reaction;
ODC: Oxygen depolarization cathode.

The electrochemical process for splitting aqueous hydrochloric acid into chlorine and hydrogen is called the Bayer-Hoechst-Uhde process. The aqueous solution used for the Bayer-Hoechst-Uhde process is 22 wt. % hydrochloric acid and operates at a current density of 4 $kA/m^2$ at a cell voltage of 2 V. This results in an energy consumption of 1500 kWh $t(Cl_2)^{-1}$ for a standard diaphragm cell. The process using an ODC in a membrane cell to convert aqueous hydrochloric acid into chlorine is called the Bayer-Uhdenora process. In this process, a gas diffusion electrode is used for the ODC, while a dimensionally stable anode (DSA) is used for chlorine evolution. The electrolyzer can be operated at a current density of 4 $kA/m^2$ at a cell voltage of 1.35 V, and so the energy consumption can be reduced to 1020 kWh $t(Cl_2)^{-1}$ for the membrane cell with the ODC.

The Bayer-Hoechst-Uhde and Bayer-Uhdenora processes involve aqueous hydrochloric acid feed to the anode. The similarity of the reversible potentials for the evolution of oxygen and chlorine in an aqueous solution combined with the mass transport limitations in a liquid causes the production of oxygen in the anode in an aqueous hydrochloric acid electrolysis process. The result is a decrease in current efficiency and corrosion of cell components.

A gaseous hydrogen chloride electrolysis process avoids this problem and operates at high current density. Another advantage of using gaseous hydrogen chloride is that the theoretical chlorine evolution potential is lowered by at least 0.3 V (0.99 V for gaseous hydrogen chloride versus 1.36 V for aqueous hydrochloric acid at standard conditions). This results in a cell voltage reduction of 0.3 V. The first proof of principle of an electrolysis of gaseous hydrogen chloride was demonstrated by DuPont (Eames, D. J., and Newman, J., *Journal of the Electrochemical Society* (1995) 142 (11), 3619; U.S. Pat. No. 5,411,641). This process for splitting gaseous hydrogen chloride into chlorine and hydrogen was conducted in a fuel cell type reactor. The reported cell voltage was 1.7 V at a current density of 10 $kA/m^2$ and resulted in an energy consumption of 1250 kWh $t(Cl_2)^{-1}$.

Further improvements of the gaseous hydrogen chloride electrolysis process employed an ODC at the cathode. Vidaković-Koch et al. indicate that the limiting step in the gaseous hydrogen chloride electrolysis with an ODC is the slow oxygen reduction reaction (ORR) kinetics (Martinez, I. G., et al., *Electrochimica Acta* (2014) 123 (0), 387). At a practical current density of 4 kA/$m^2$, the overpotential for the oxidation of hydrogen chloride gas (HClOR) is about 0.09 V but the overpotential for the ORR is about 0.8 V even with a platinum catalyst which is considered the best electrocatalyst for the ORR. However, platinum does not have sufficient stability in the highly corrosive hydrochloric acid electrolyte and chloride ions can strongly adsorb on the platinum surface, leading to low activity of the ORR (Maljusch, A., et al., *Analytical Chemistry* (2010) 82 (5), 1890; Ziegelbauer, J. M., et al., *Electrochimica Acta* (2007) 52 (21), 6282). A rhodium-based material, specifically $Rh_xS_y$, (Jin, C., et al., *ChemSusChem* (2011) 4 (7), 927; Gullá, A. F., et al., *Applied Catalysis A: General* (2007) 326 (2), 227) was applied as an oxygen reduction catalyst for a commercial aqueous hydrochloric acid electrolysis with an ODC process. However, rhodium is also an expensive precious metal which would increase the electrolysis cell cost.

SUMMARY OF THE INVENTION

One aspect of the invention is a cathode comprising: (a) an electron conductor; (b) a cathode electrolyte comprising Fe(II) compounds and Fe(III) compounds in contact with the electron conductor; and (c) a reactor comprising a reactor solution comprising an oxidant in fluid contact with the cathode electrolyte. The fluid contact of the reactor solution with the cathode electrolyte allows the cathode electrolyte rich in Fe(II) compounds to be transferred to the reactor and combined with the reactor solution and the reactor solution rich in Fe(III) compounds to be transferred from the reactor to the cathode electrolyte after the oxidant of the reactor solution reacts with the electrolyte rich in Fe(II) compounds to form the reactor solution rich in Fe(III) compounds.

Another aspect is an electrolysis device for producing chlorine gas comprising: an anode for oxidizing hydrogen chloride gas to form chlorine gas, the anode comprising an electron conductor; a cathode as described herein; and a membrane adjacent to the anode and to the cathode.

Yet another aspect of the invention is a method of generating electricity using an electrolysis device as described herein comprising reducing Fe(III) compounds to Fe(II) compounds at the cathode; oxidizing the Fe(II) compounds in the reactor to form Fe(III) compounds and water; and contacting the Fe(III) compounds from the reactor with the cathode.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
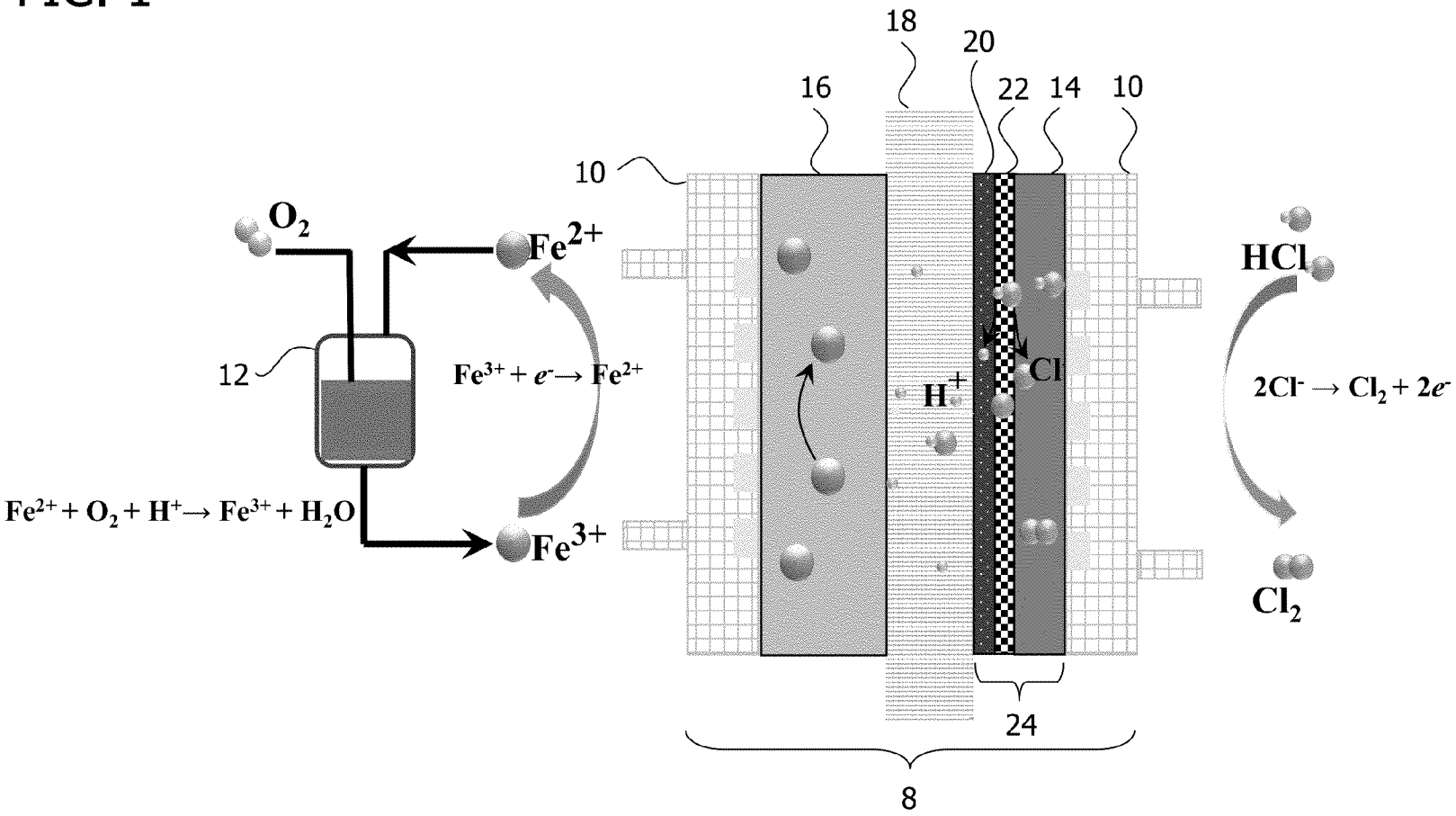
FIG. 1 is a schematic of the electrolysis device described herein.

The present invention is generally directed to a high performance electrolysis device for converting gaseous hydrogen chloride into chlorine gas. The device operates with an energy consumption below 1,000 kWh/t$Cl_2$, and is a low cost device which may have a cathode free of precious metal catalysts. More specifically as compared to the known processes in Table 1 above, an electrolysis device of the invention comprising a Pt/C anode catalyst, an iron reduction cathode free of precious metal or rhodium-based catalysts, and a Nafion separator with direct gaseous hydrogen chloride feed on the anode and operating at 40° C., 10 kA/m$^2$ current density, and 0.67-0.90 V unit-cell voltage has an energy consumption of 509-680 kWh/t$Cl_2$.

One aspect of the present invention is directed to a cathode comprising a cathode electrolyte comprising Fe(II) compounds and Fe(III) compounds in contact with an electron conductor; and a reactor comprising a reactor solution comprising an oxidant in fluid contact with the cathode electrolyte. The fluid contact of the reactor solution with the cathode electrolyte allows the cathode electrolyte rich in Fe(II) compounds to be transferred to the reactor and combined with the reactor solution, and the reactor solution rich in Fe(III) compounds to be transferred from the reactor to the cathode electrolyte after the oxidant of the reactor solution reacts with the electrolyte rich in Fe(II) compounds to form the reactor solution rich in Fe(III) compounds.

The cathode electrolyte and reactor solution used in the cathode can be aqueous solutions.

The reactor solution used in the cathode can further comprise hydrochloric acid. As the hydrochloric acid concentration increases, the reaction time decreases for oxidation of Fe(II) to Fe(III). Preferably, the reactor solution comprises at least 1 M hydrochloric acid. Most preferably, the reactor solution comprises at least 4 M hydrochloric acid. The reaction temperature also decreases with the concentration of the hydrochloric acid.

The electron conductor of the cathode can comprise a porous carbon material, such as carbon paper, graphite felt, carbon felt, carbon cloth, or a combination thereof.

The electron conductor used in the cathode can be heat treated to introduce oxygen-containing groups on the electron conductor.

The ratio of Fe(III) compounds to Fe(II) compounds in the cathode electrolyte can be from about 90:10 to about 10:90. Alternatively, the ratio of Fe(III) compounds to Fe(II) compounds in the cathode electrolyte is from about 95:5 to about 85:15.

The cathode described herein is preferably free of precious metal and free of rhodium-based metals.

Another aspect of the invention is an electrolysis device for producing chlorine gas comprising (a) an anode for oxidizing hydrogen chloride gas to form chlorine gas, the anode comprising an electron conductor; (b) a cathode described herein; and (c) a membrane adjacent to the anode and to the cathode.

The electron conductor of the anode can comprise a porous carbon material, such as carbon paper, graphite felt, carbon felt, carbon cloth, or a combination thereof.

The electron conductor of the anode can comprise a gas diffusion material. For example, the electron conductor can include commercially available gas diffusion materials comprised of carbon papers or carbon cloths with carbon particles deposited on one side of the paper or cloth. Examples include SGL25 BC, SGL25 CC (SGL Carbon Corp) or TGP-H-60, TGP-H-120 (Toray Corp).

The anode of the electrolysis device can further comprise a catalyst, such as platinum, ruthenium, osmium, rhenium, rhodium, iridium, palladium, gold, titanium, zirconium, or an oxide, an alloy, or mixture thereof.

The anode of the electrolysis device can further comprise a binder, such as a sulfonated tetrafluoroethylene copolymer, a polytetrafluoroethylene (PTFE), a polyvinylidene difluoride (PVDF), or a combination thereof.

The membrane of the electrolysis device can be a cation exchange membrane, an anion exchange membrane, or a porous membrane. Exemplary membranes include a sulfonated tetrafluoroethylene based fluoropolymer-copolymer commercially available as Nafion® from DuPont, a sulfonated tetrafluoroethylene/PTFE composite polymer, and a poly(ether sulfone)/sulfonated poly(ether ether ketone) porous membrane.

The choice of membrane thickness and composition determines such properties as conductivity, catholyte species uptake, and electroosmotic drag, each of which affected overall cell performance.

The electrolysis device can also include a current collector, which can collect electrons on the anode side or disburse electrons on the cathode side of the device. The current collector can be made of conductive, porous, inert material (e.g., a metal or conductive polymer). The current collectors can form the outer walls of the device. When the device is a stack including multiple anode/cathode assemblies, the current collector is preferably a bipolar plate.

Yet another aspect is a method of generating electricity using the electrolysis device described herein comprising oxidizing the hydrogen chloride gas at the anode to form chlorine gas; reducing Fe(III) compounds to Fe(II) compounds at the cathode; oxidizing the Fe(II) compounds in the reactor to form Fe(III) compounds and water; and contacting the Fe(III) compounds from the reactor with the cathode.

An electrochemical process for gaseous HCl electrolysis comprising an electrolysis cell 8 and a reactor 12 is shown in FIG. 1. At an anode 24, the hydrogen chloride gas is oxidized to generate chlorine and protons. At the cathode 16, the reduction of Fe(III) to Fe(II) replaces the ODC and HER reactions of the known processes as described above. Fe(II) is subsequently oxidized to Fe(III) with oxygen in a reactor 12 external to the electrolysis cell 8 and recycled back to the electrolysis process. A membrane 18 separates the anode 24 from the cathode 16.

As shown in FIG. 1, the cathode 16 comprises an electron conductor (e.g., graphite felt). A current collector 10 (e.g., graphite plate) is on the outside of an individual electrochemical cell adjacent the cathode. The anode 24 comprises an hydrophobic layer 20 (e.g., carbon layer) between the membrane 18 (e.g., Nafion) and a catalyst 22. The gas diffusion layer 14 of the anode is between the catalyst 22 and a current collector 10.

Using the Fe(III)/Fe(II) redox couple in the cathode is advantageous as compared to ORR and HER reactions. The exchange current density of the Fe(III)/Fe(II) couple is approximately $10^{-2}$ A/cm$^2$ on carbon which is several orders of magnitude higher than that of the ORR on platinum (approximately $10^{-7}$ A/cm$^2$). Thus, the Fe(III) reduction reaction is significantly faster on carbon than the ORR on platinum catalysts. Consequently, a precious metal catalyst (e.g., platinum) is not needed for the cathode thus, reducing the electrolysis cell cost. Additionally, the fast kinetics of the reaction produce lower over-voltage.

Regeneration of Fe(III) can be achieved by reoxidizing Fe(II) with oxygen or air. For example, Fe(II) in an aqueous solution with hydrochloric acid concentrations above 4 M Fe(II) can be rapidly oxidized by oxygen.

Figure 2:
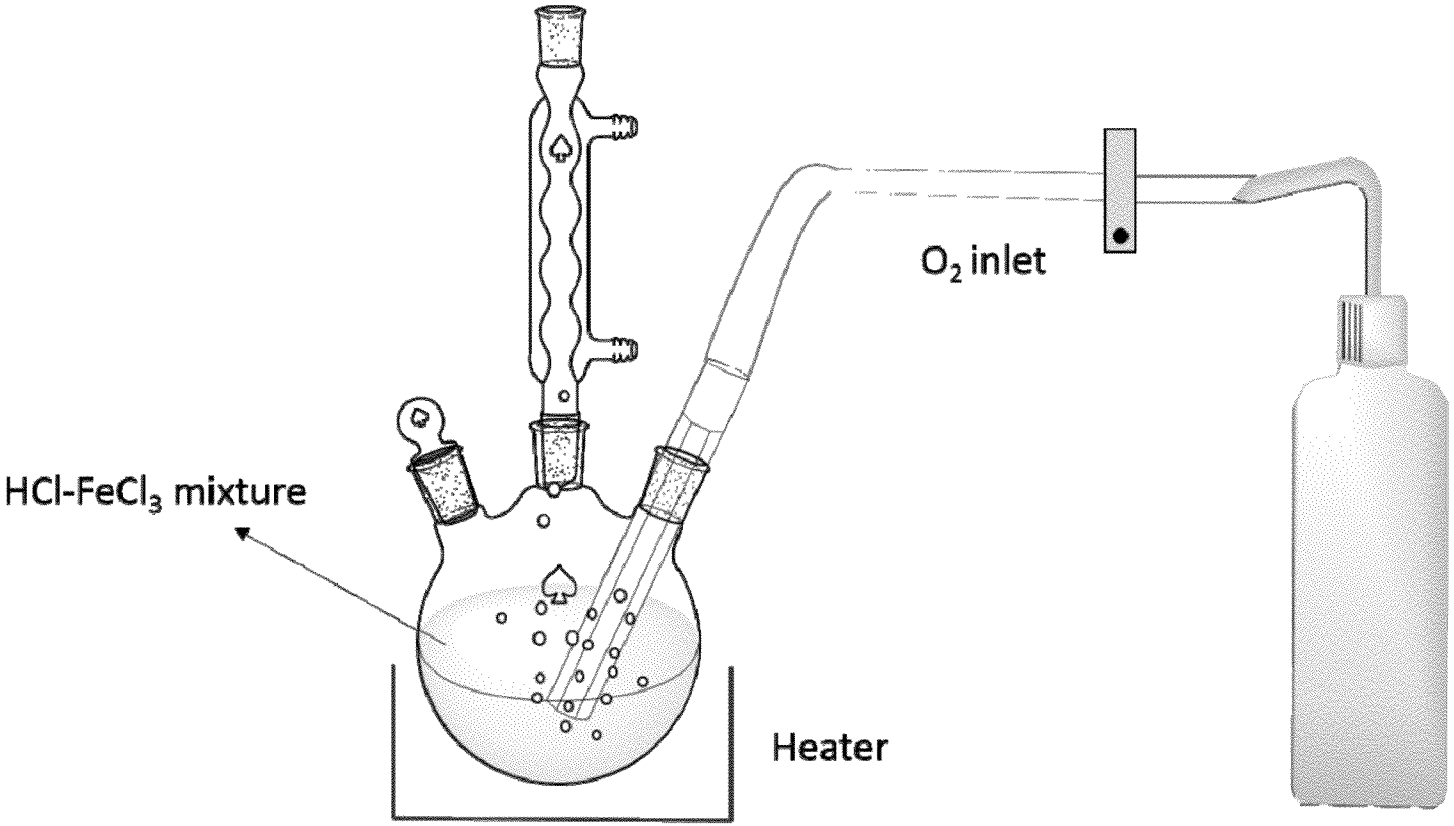
FIG. 2 is a schematic of the oxidation of Fe(II) in the reactor of the cathode.
Figure 3:
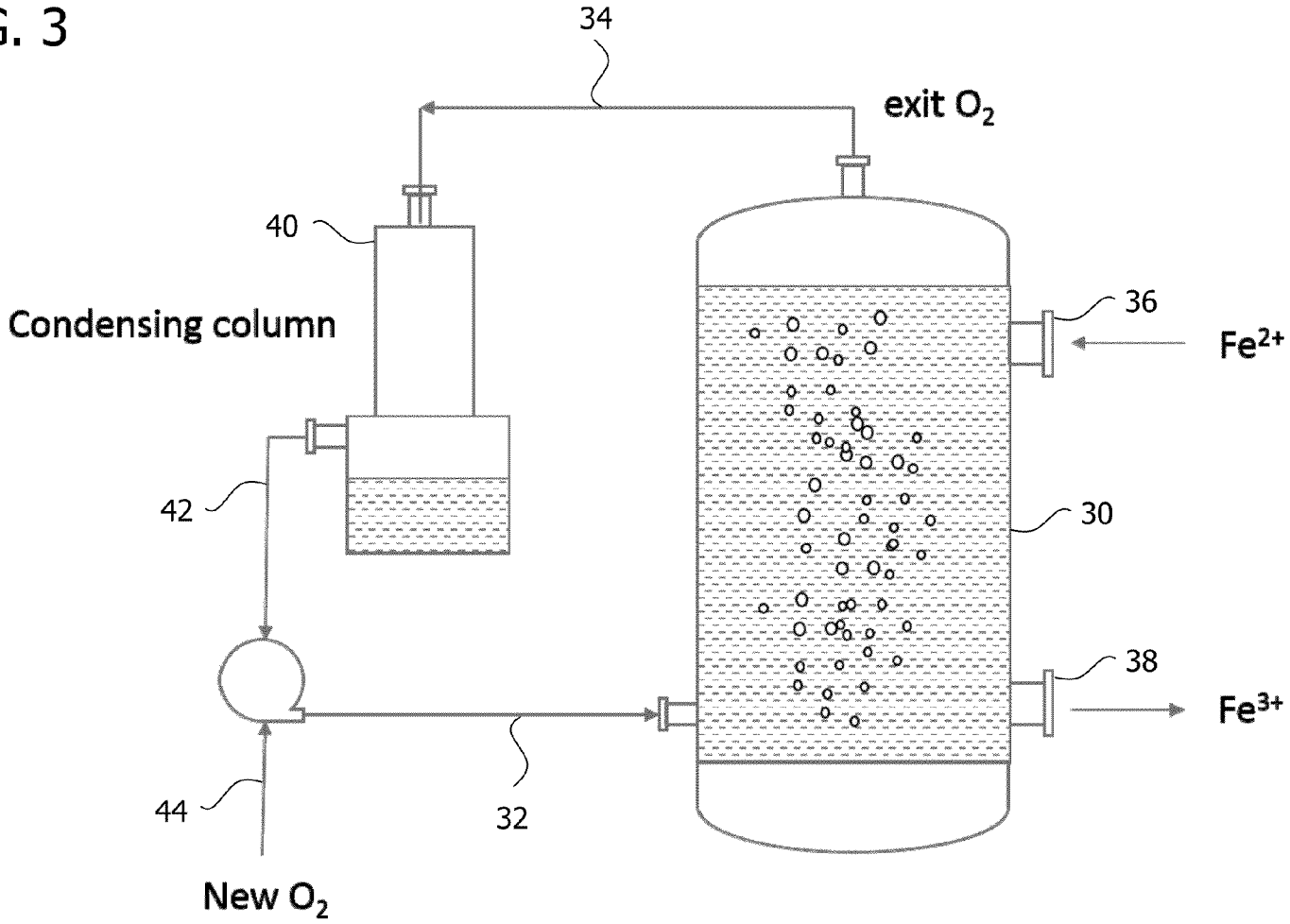
FIG. 3 is a schematic of a bubble column reactor for use in oxidation of Fe(II).

A batch reactor for Fe(II) chloride oxidation to Fe(III) chloride is shown in FIG. 2. Oxidation of Fe(II) can be facilitated by using magnetic stirring and temperature control. A predetermined concentration of hydrochloric acid and 1 M Fe(II) chloride mixture can be placed into the batch reactor and oxygen can be added to the bottom of the solution through a porous tube to produce small gas bubbles. In this system, the oxygen flow rate can be determined (e.g., 50-1000 mL/minute or preferably 200 mL/minute) with a rotameter. Fe(II) to Fe(III) conversion can be calculated from the results of a permanganate titration of the solution before starting the reaction and at given time intervals during the reaction. The reoxidation of Fe(II) can also be performed in a large-scale reactor that is characteristic of a bubble column reactor (See FIG. 3). A bubble column reactor is preferred for large scale implementation of the process due to its simplicity and low operating and maintenance cost. In addition, other gas-liquid reactors or contactors can be used for the reoxidation of Fe(II), such as a packed column or a plate column, As shown in FIG. 3, oxygen gas is introduced into the column 30 via a line 32. Oxygen gas exits from the top of the column at line 34. The Fe(II) containing electrolyte enters the top of the column 30 at inlet 36 and exits from the bottom through outlet 38, although other arrangements are possible. The oxygen exiting from the top of the column at line 34 is put through a condenser column 40 to remove water, and recycled to the column 30 via line 42. The oxygen being recycled is supplemented with new oxygen via line 44 to make up for the oxygen consumed in the oxidation and pumped back into the column via line 32.

The oxidation reaction is

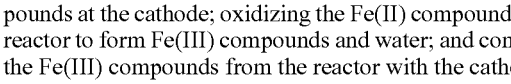

$$\tfrac{1}{2}O_2+2Fe^{2+}+2H^+\rightarrow H_2O+2Fe^{3+}$$

wherein water is produced. As the process continues, more water will be accumulated. This water can be removed to maintain a concentration of iron and a concentration of hydrochloric acid sufficient for reactivity of Fe(II). The condenser 40 removes the water 46 exiting the bubble column 30 through the oxygen stream.

If hydrogen chloride gas crosses over from the anode to the cathode, the hydrogen chloride gas can be removed in the condenser 40.

For preparing the membrane electrode assembly (MEA), the anode electrode can be prepared by spraying or spreading the homogeneous catalyst composition.

When using the spraying method, a homogeneous ink containing an anode catalyst (e.g., Pt/C 20-70 wt. %, Tanaka Kikinzoku Kogyo (TKK)), a binder solution (e.g., Nafion, 1-10 wt. %, DuPont) and a solvent (e.g., isopropanol, ethanol or n-propanol) can be sprayed onto a microporous layer (MPL) of a commercially available gas diffusion layer (GDL) (e.g., SGL25 BC, SGL25 CC (SGL Carbon Corp) or TGP-H-60, TGP-H-120 (Toray Corp)). The composition of the dry catalyst layers can be 20-95 wt. % catalyst (Pt/C) and 5-80 wt. % binder (e.g., Nafion), at a platinum loading of 0.3-1 mg Pt/cm$^2$.

When using the spreading method, a homogeneous ink containing an anode catalyst, (e.g., Pt/C (20-70 wt. %, TKK)), a binder solution (e.g., a poly(tetrafluoroethylene) (PTFE) emulsion) and a solvent (e.g., ethanol, isopropanol or n-propanol) can be coated on a microporous layer (MPL) of a commercially available GDL (e.g., SGL25 BC, SGL 25CC (SGL Carbon Corp) or TGP-H-60, TGP-H-120 (Toray Corp)) using a blade, followed by calcining at 200-250° C. for 30-120 minutes and 300-350° C. for 30-120 minutes in $N_2$ or Ar to form the electrode. The composition of the dry catalyst layers can be 20-95 wt. % catalyst (Pt/C) and 5-80 wt. % binder (PTFE) at a platinum loading of 0.3-1 mg Pt/cm$^2$.

In fabricating the MEA assembly, the cathode electrode can be untreated graphite felt (KFA-5, SGL Carbon Corp), carbon paper (TGP-H-60), treated graphite felt or treated carbon paper. Though Fe(III)/Fe(II) redox exhibits quite fast kinetics on the carbon electrode, electrode kinetics of the Fe(III)/Fe(II) redox system is affected by carbonyl functional groups present on the electrode surface (Pupkevich, V., et al., *Electrochemistry Communications* (2007) 9 (8), 1924). Heat treatment is an effective way to introduce oxygen-containing groups on the carbon (graphite) surfaces. The treated graphite felt can be prepared via thermal oxidation at 350-550° C. in air for 2-10 hours. The anode electrode, Nafion® membrane, and cathode electrode can be assembled directly to form the MEA for an iron reduction cathode (IRC) electrolysis cell. The anode and cathode can be separated by ion exchange membrane or porous membrane and assembled for the IRC electrolysis cell.

A 5 $cm^2$ cell with graphite current collectors can be used (Fuel Cell Technologies). Dry hydrogen chloride can be supplied to the anode at 50 mL/minute through a rotameter. Aqueous catholyte solutions can be prepared by mixing iron chloride and hydrochloric acid. Catholyte solutions can be magnetically stirred and supplied to the cathode at 200 mL/minute by a peristaltic pump. The electrolysis cell can be operated at 25-80° C. at 0-75 psi absolute pressure. The electrochemical measurements can be performed with a power supply (BK9171, BK Precision). Voltage-current curves (U-I curve) can be recorded through increasing the current density at different Fe(III)/Fe(II) ratios conditions. The different Fe(III)/Fe(II) ratio states can be checked at a given time interval and determined with permanganate titration of the solution. Electrochemistry impedance spectroscopy (EIS) can be carried out using a Solartron 1287 Electrochemical Interface in conjunction with a Solartron 1260 Frequency Response Analyzer at frequencies from 1 Hz to 100 kHz at the open circuit condition.

As described in more detail in the examples, an IRC membrane electrolysis device was developed to recover chlorine from gaseous hydrogen chloride to achieve low cost and energy consumption. The best cell performance at a temperature of 40° C. with a cell voltage of 0.673 V was obtained at the Fe(III)/Fe(II) (90/10) ratio state when operated at the current density of 4 $kA/m^2$. This process did not use precious platinum-based or rhodium-based catalysts on the cathode.

The cathodes described herein are useful in electrolysis devices for recovering chlorine from gaseous HCl. In addition to chlorine recycling, the cathodes may be used for additional electrochemical processes such as bromine recycling.

Having described the invention in detail, it will be apparent that modifications and variations are possible without departing from the scope of the invention defined in the appended claims.

EXAMPLES

The following non-limiting examples are provided to further illustrate the present invention.

Example 1

Electrolysis Device with Fe(II)/Fe(III) Couple

The electrolysis device as shown in FIG. 1 was used in combination with the reactor shown in FIG. 2 where the oxidation of Fe(II) was carried out using magnetic stirring and temperature control. A mixture of a hydrochloric acid with a predetermined concentration and 1 M ferrous chloride was used in the system of FIG. 2 by introducing oxygen to the bottom of the solution. The oxygen flow rate was determined as 200 mL/minute with a rotameter. The Fe(II) to Fe(III) conversion was calculated from the results of permanganate titration of the solution before the start of the reaction and at given time intervals during the reaction.

Figure 4:
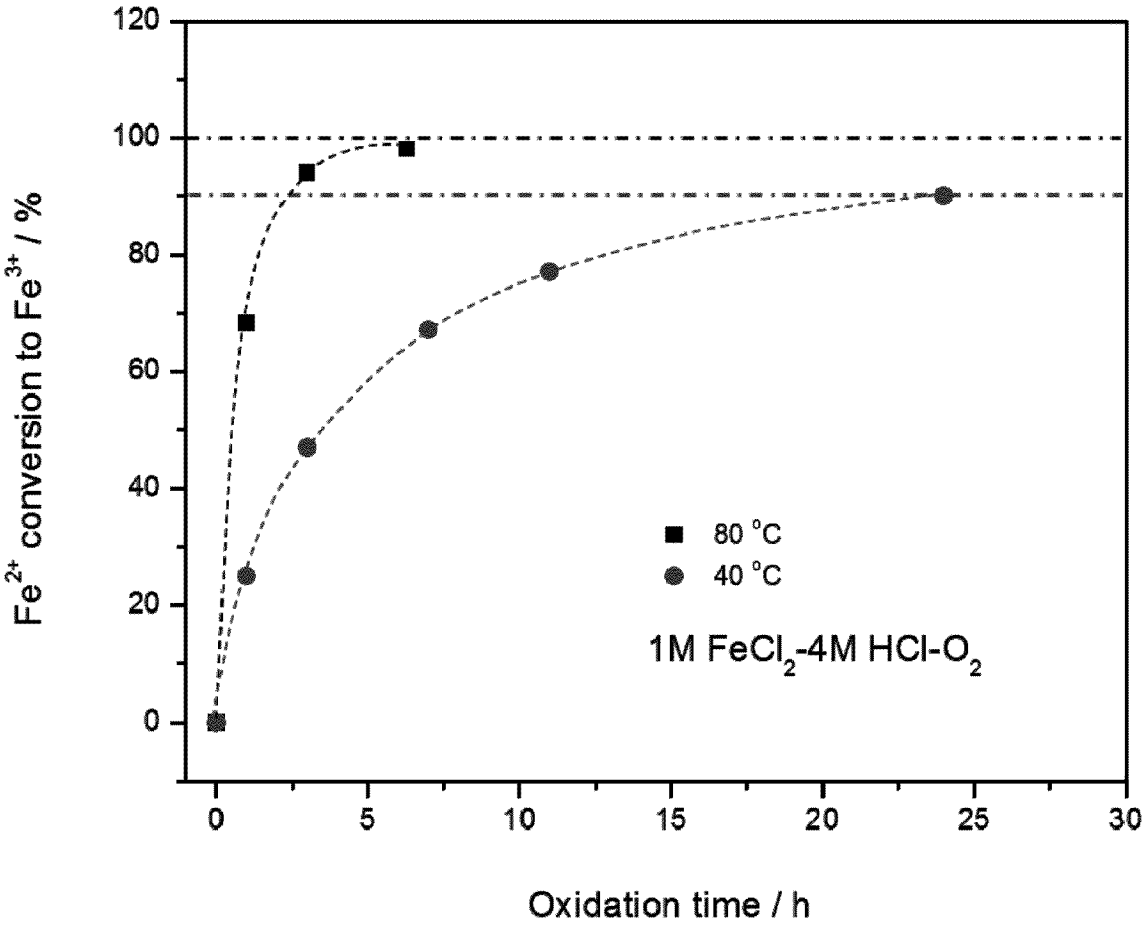
FIG. 4 is a graph of the percent Fe(II) to Fe(III) conversion versus the oxidation time in hours at 40° C. (●) and 80° C. (■) and 1 M $FeCl_2$, and 4M HCl—$O_2$.

As shown in FIG. 4, the conversion of Fe(II) oxidation increased with time or temperature. Conversion of Fe(II) oxidation reached 90% after 24 hours at 40° C. At 80° C., the conversion of Fe(II) oxidation reached over 90% in 3 hours.

Figure 5:
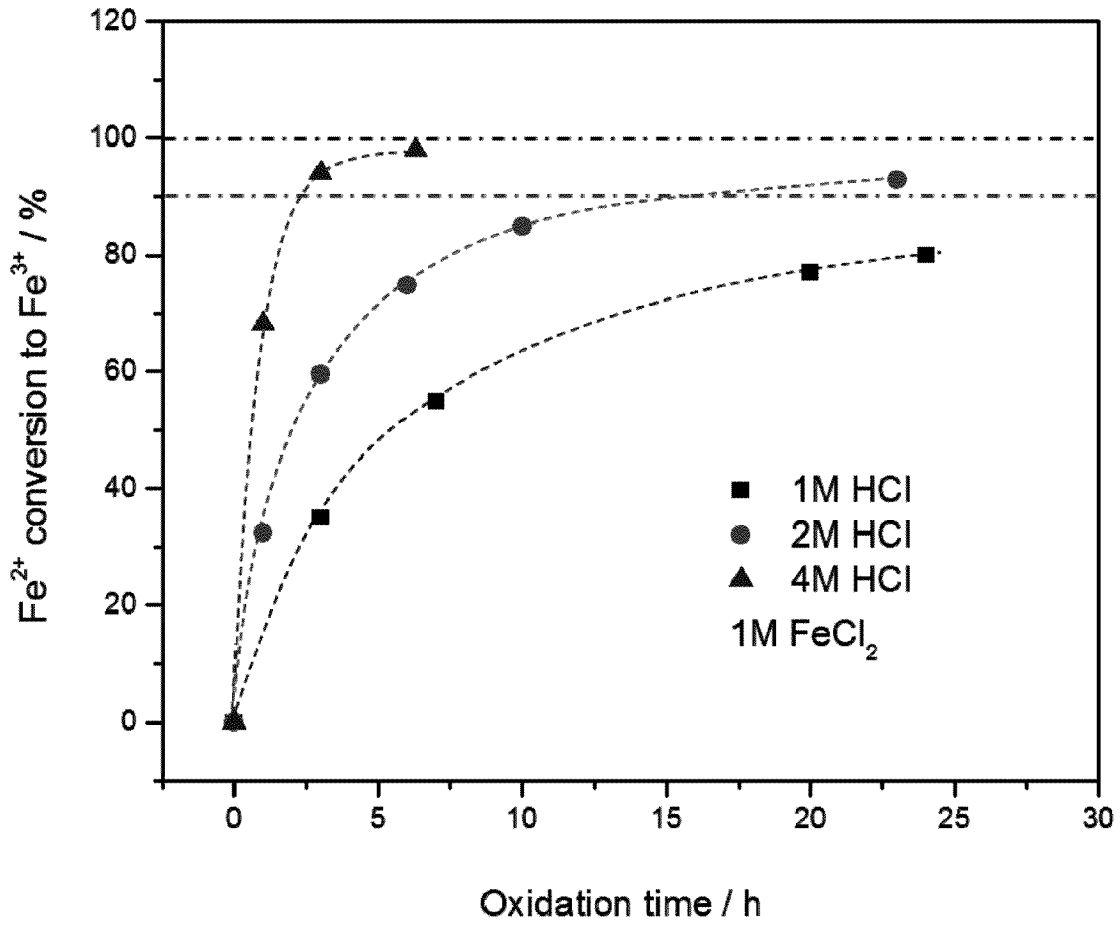
FIG. 5 is a graph of percent Fe(II) to Fe(III) conversion versus the oxidation time in hours at 80° C. and 1 M $FeCl_2$, and 1M HCl (■), 2M HCl (●), and 4M HCl (▲).

The benefit of high hydrochloric acid concentration for Fe(II) oxidation is shown in FIG. 5. The conversion of Fe(II) oxidation reached 80% after 24 hours at 1 M hydrochloric acid at 80° C. The conversion of Fe(II) oxidation was enhanced when 4 M hydrochloric acid was used and it reached 90% conversion after only 3 hours.

Figure 6:
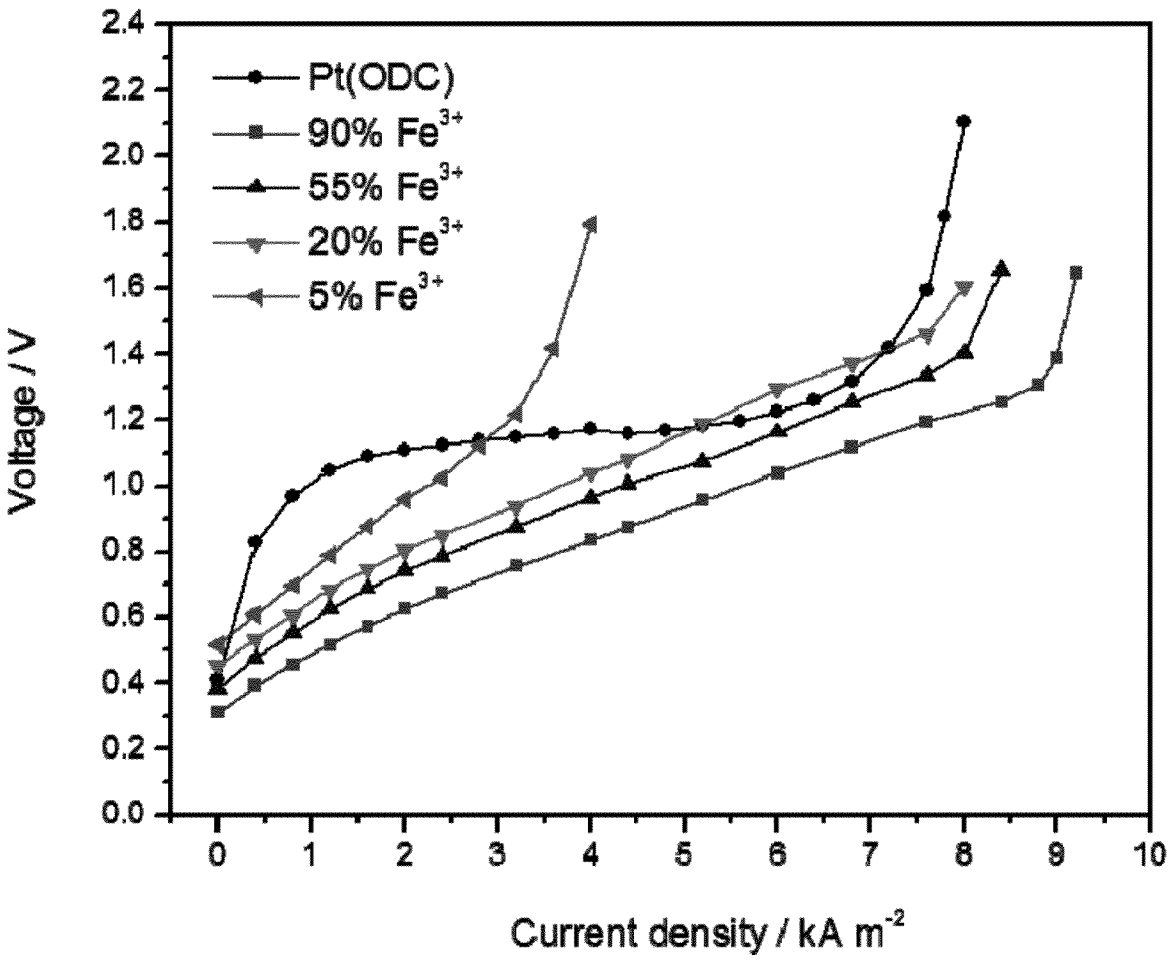
FIG. 6 is a graph of the voltage versus current density for different Fe(III):Fe(II) ratios of 90:10 (i.e., 90% $Fe^{3+}$)(■), 55:45 (i.e., 55% $Fe^{3+}$)(▲), 20:80 (i.e., 20% $Fe^{3+}$)(▼), 95:5 (i.e., 5% $Fe^{3+}$)(◀), wherein the cell temperature is 40° C.; the anode had a gaseous HCl feed of 50 mL/min; the cathode had initial 1 M $FeCl_3$ and 1 M HCl mixture of 200 mL/min; the membrane electrode assembly (MEA) was Nafion 117, Pt/C (0.6 mg Pt/$cm^2$) and Nafion (35 wt. %) in the anode, and graphite felt in the cathode. For the ODC case (●), the MEA was Nafion 117, Pt/C (0.6 mg Pt/$cm^2$) and Nafion (35 wt. %) in both anode and cathode.

As shown in FIG. 6 the electrolysis cell performance with iron reduction cathode (IRC) is better than the electrolysis cell performance with ODC when the Fe(III) concentration is high in 1 M hydrochloric acid. At a practical current density of 4 $kA/m^2$, the electrolysis cell with IRC exhibited a voltage of 0.835 to 1.04 V in the Fe(III) percent range of 90%-20% which is lower than the electrolysis cell with ODC (1.172 V) under the same conditions. Three regions can be clearly distinguished for the electrolysis cell with ODC. At current densities below 1 $kA/m^2$, the overall process is mostly kinetically controlled. Raising the current density further a second region is observed where the voltage increases linearly only very slightly with the current density. Here, it is generally assumed that ohmic losses govern the cell performance. In the third region the cell voltage increases again considerably with increasing current density, likely caused by mass transport limitations.

Figure 7:
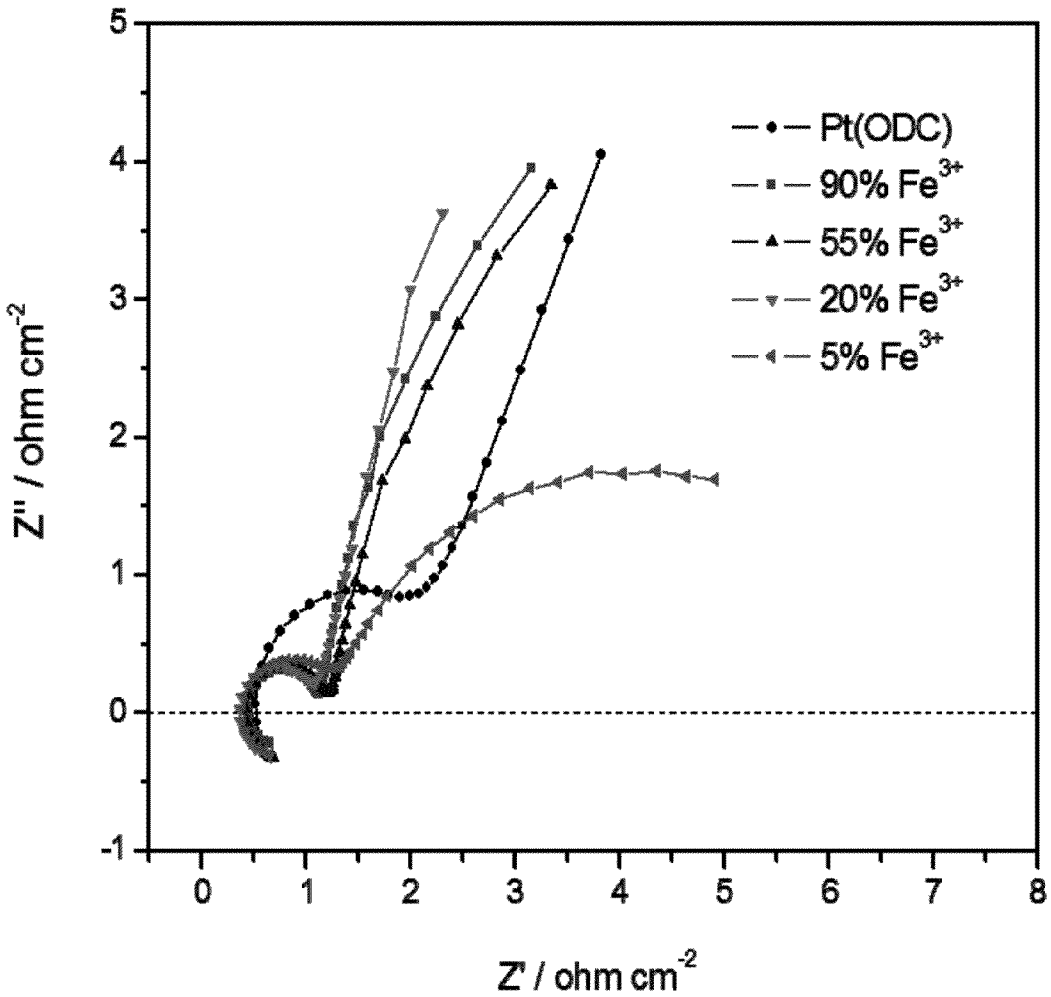
FIG. 7 is a series of Nyquist diagrams for the electrolysis cell at open circuit voltage conditions wherein the cell temperature is 40° C.; the anode had a gaseous HCl feed of 50 mL/min; the cathode had initial 1 M $FeCl_3$ and 1 M HCl mixture of 200 mL/min; the membrane electrode assembly (MEA) was Nafion 117, Pt/C (0.6 mg Pt/$cm^2$) and Nafion (35 wt. %) in the anode, and graphite felt in the cathode. For the ODC case (●), the MEA was Nafion 117, Pt/C (0.6 mg Pt/$cm^2$) and Nafion (35 wt. %) in both anode and cathode.

As shown in FIG. 7, the electrolysis cell with ODC exhibits a resistance (0.5 $\Omega\ cm^2$) similar to that of an electrolysis cell with IRC at the open circuit voltage condition. However, the electrolysis cell with ODC exhibits a high charge transfer resistance due to the poor ORR kinetics as compared with IRC.

Figure 8:
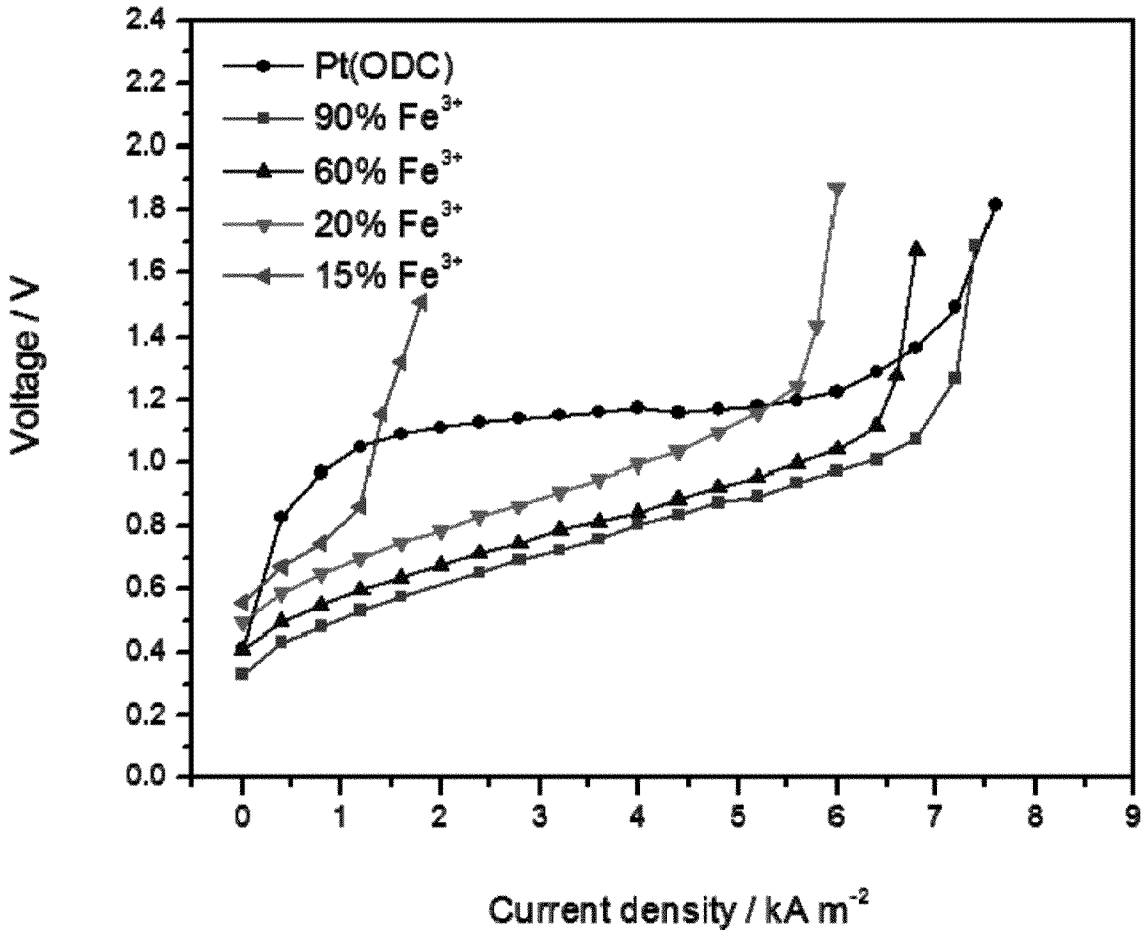
FIG. 8 is a graph of the voltage versus current density for different Fe(III):Fe(II) ratios of 90% $Fe^{3+}$ (■), 60% $Fe^{3+}$ (▲), 20% $Fe^{3+}$ (▼), 15% $Fe^{3+}$ (◀), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Nafion 117, Pt/C (0.6 mg Pt/$cm^2$) and Nafion (35 wt. %) in the anode, and graphite felt in the cathode. For the ODC case (●), the MEA was Nafion 117, Pt/C (0.6 mg Pt/$cm^2$) and Nafion (35 wt. %) in both anode and cathode.

In FIG. 8, the electrolysis cell with IRC still shows a better performance in the Fe(III) percent range of 90%-20% when 4 M hydrochloric acid is used in the catholyte. At a practical current density of 4 $kA/m^2$, the voltage can stay at 0.804 to 0.995 V, which is higher than the voltage of the electrolysis cell with ODC.

Figure 9:
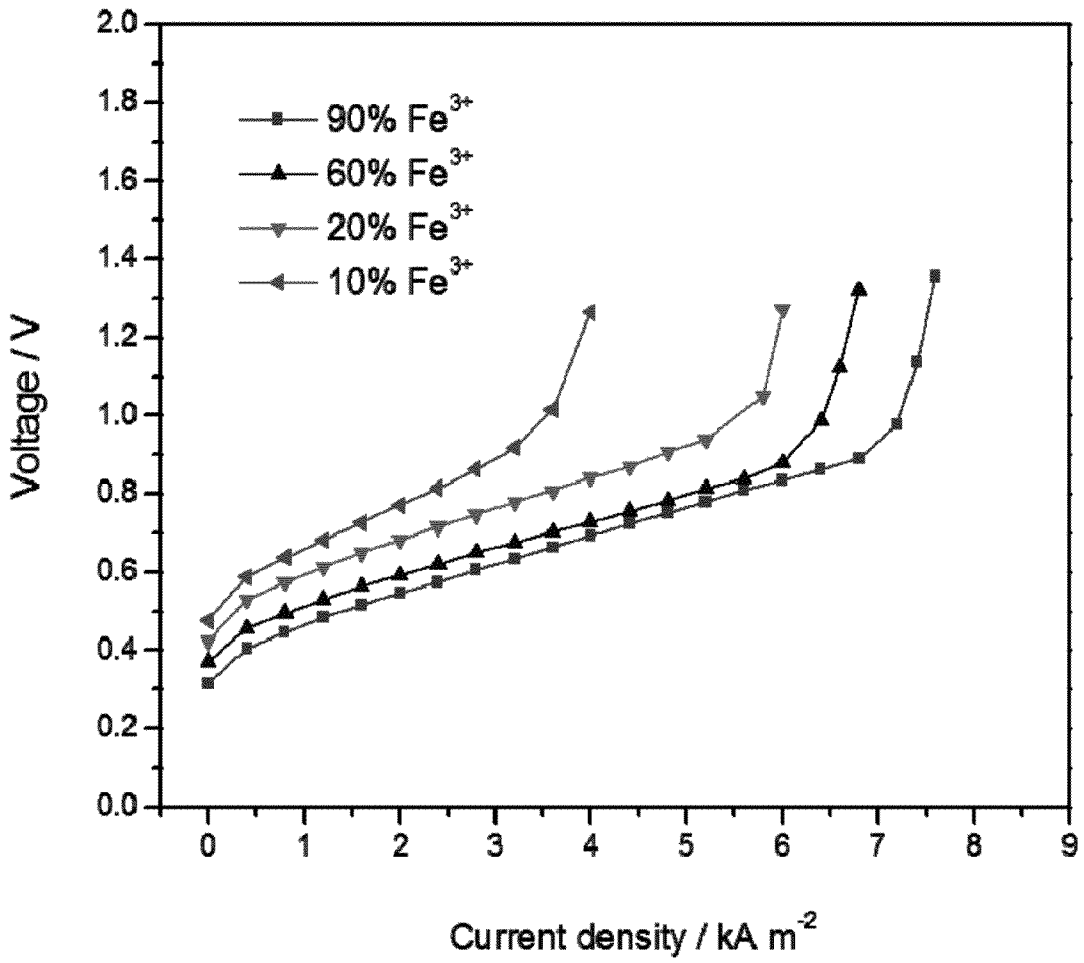
FIG. 9 is a graph of the voltage versus current density for different Fe(III):Fe(II) ratios of 90% $Fe^{3+}$ (■), 60% $Fe^{3+}$ (▲), 20% $Fe^{3+}$ (▼), 10% $Fe^{3+}$ (◀), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Nafion 117, Pt/C (0.6 mg Pt/$cm^2$) and PTFE (36 wt. %) in the anode, and graphite felt in the cathode.

When considering the effect of different anode binders on the performance of electrolysis cell, better cell performance was achieved when substituting PTFE for Nafion as the binder in the anode catalyst layer. As shown in FIG. 9, the voltage of the cell with PTFE can maintain 0.692 to 0.843 V in the Fe(III) percent range of 90%-20% when the cell operates at the current density of 4 $kA/m^2$. PTFE can increase the hydrophobicity of the anode catalyst layer which improves the hydrogen chloride gas diffusion and enhanced cell performance.

Figure 10:
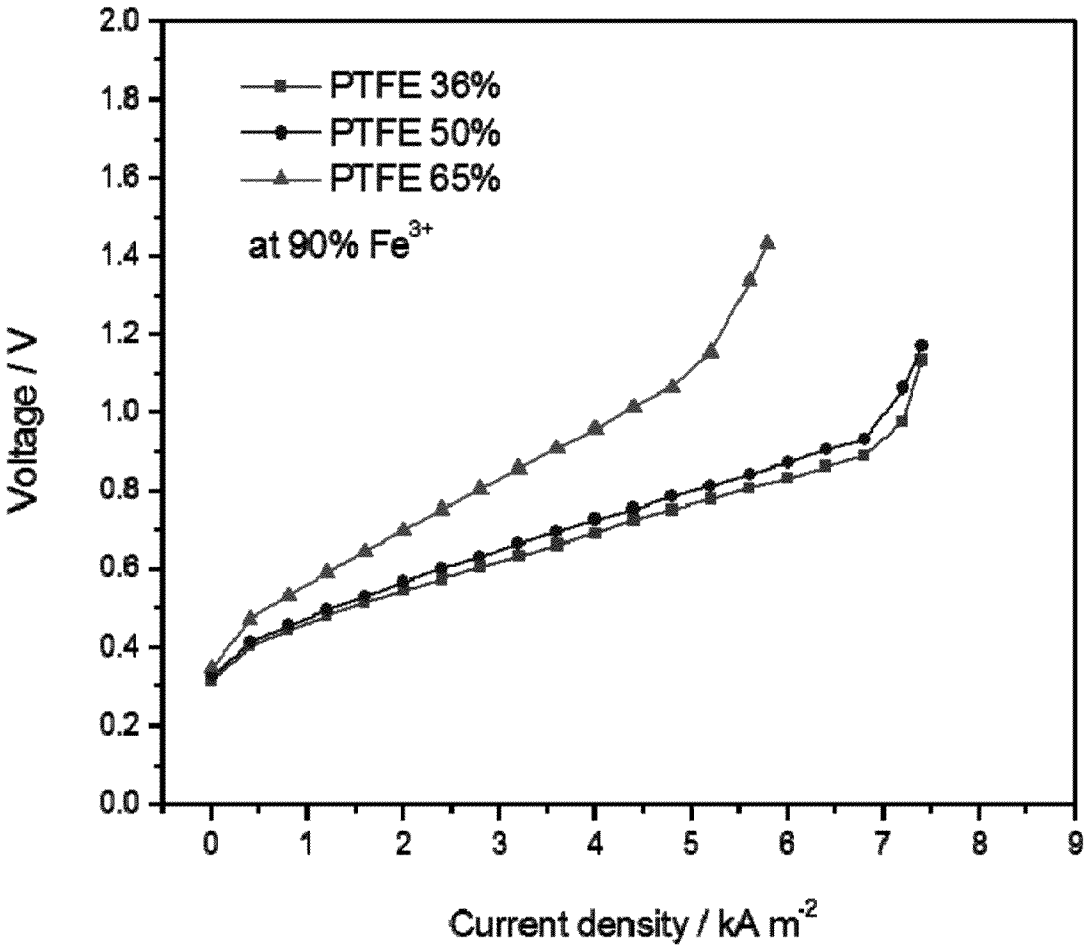
FIG. 10 is a graph of the voltage versus current density at 90% $Fe^{3+}$, wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Nafion 117, Pt/C (0.6 mg Pt/$cm^2$) and PTFE (36 wt. % (■), 50 wt. % (●), and 65 wt. % (▲)) in the anode, and graphite felt in the cathode.

The effect of different PTFE content in the anode catalyst layer on performance of the electrolysis cell was also determined. As shown in FIG. 10, too much PTFE decreased the performance of the electrolysis cell. The performance of the cell decreases at higher PTFE content because a larger portion of the platinum catalysts are covered by PTFE, and thus, lost their catalytic activity.

Figure 11:
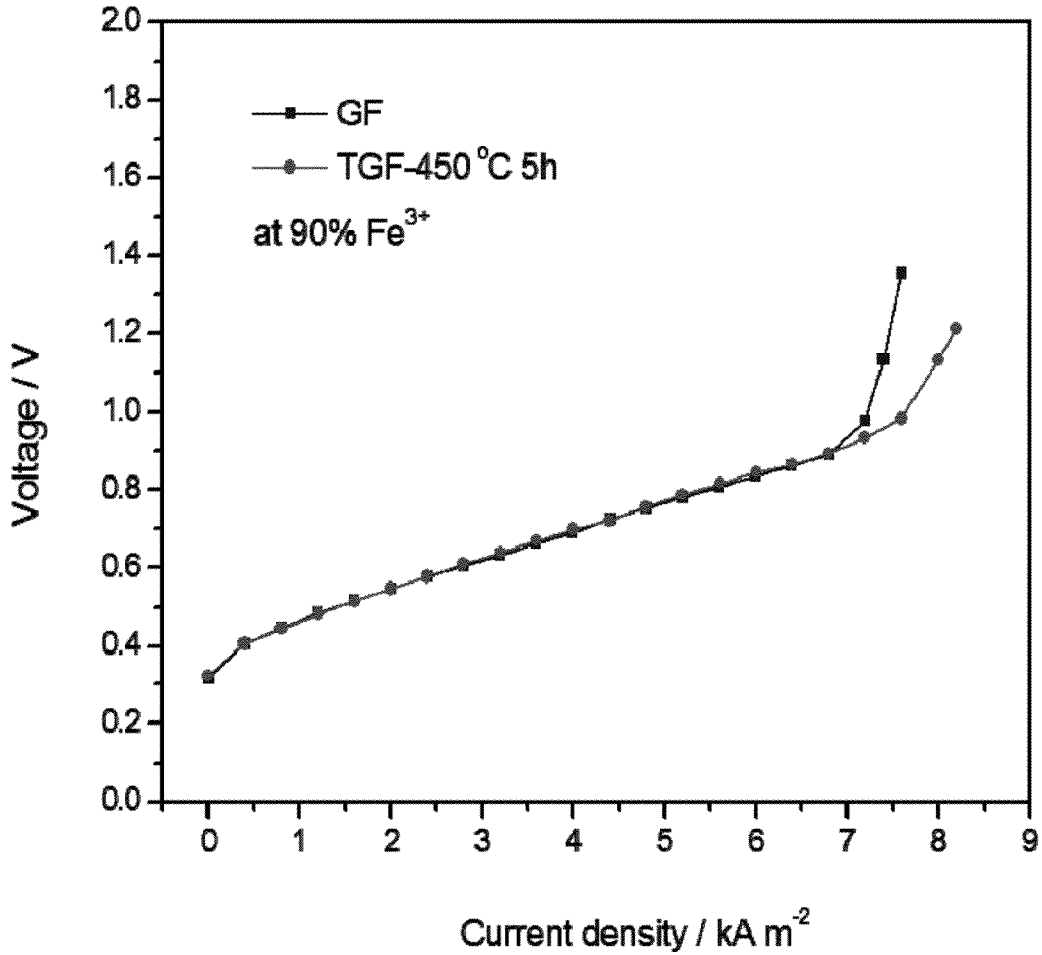
FIG. 11 is a graph of the voltage versus current density for a Fe(III):Fe(II) ratio of 90:10 (i.e., 90% $Fe^{3+}$), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Nafion 117, Pt/C (0.6 mg Pt/$cm^2$) and PTFE (36 wt. %) in the anode, untreated graphite felt (■) and thermal activated graphite felt (●) (450° C. for 5 hours) in the cathode.
Figure 12:
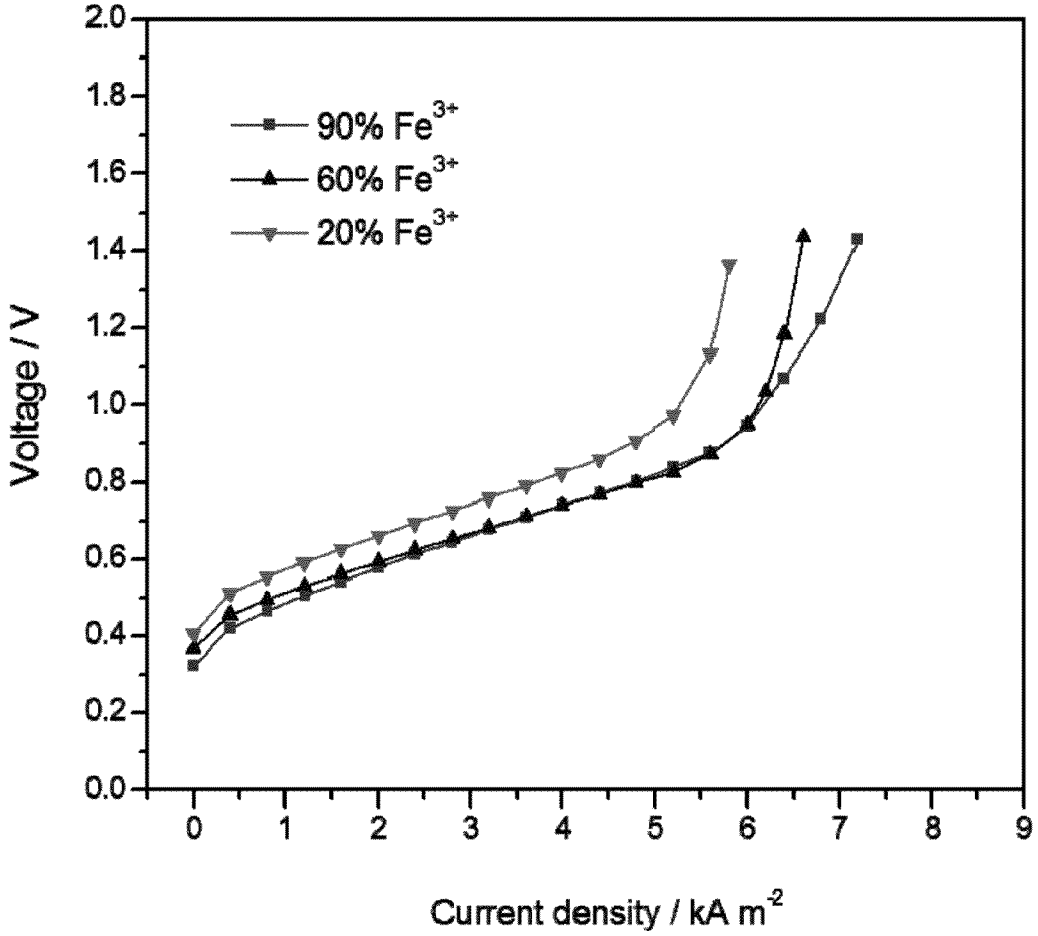
FIG. 12 is a graph of the voltage versus current density for different Fe(III):Fe(II) ratios of 90% $Fe^{3+}$ (■), 60% $Fe^{3+}$ (▲), 20% $Fe^{3+}$ (▼), wherein the cell temperature is 40° C.; the anode had a gaseous HCl feed of 100 mL/min; the cathode had initial 1 M $FeCl_3$ and 4 M HCl mixture of 200 mL/min; the membrane electrode assembly (MEA) was Nafion 117, Pt/C (0.6 mg Pt/$cm^2$) and PTFE (36 wt. %) in the anode, stacked (×3) carbon papers in the cathode.

When the influence of thermal activated graphite felt on the performance of electrolysis cell was investigated, as shown in FIG. 11, the thermal activated graphite felt can extend current density. Carbon paper is also a good choice for the Fe(III)/Fe(II) redox electrode. when the electrolysis cell was set up with stacked (×3) carbon papers in the cathode, the voltage can be maintained at 0.74 to 0.825 V in the Fe(III) percent range of 90%-20% when the cell operates at the current density of 4 $kA/m^2$ (FIG. 12).

Figure 13:
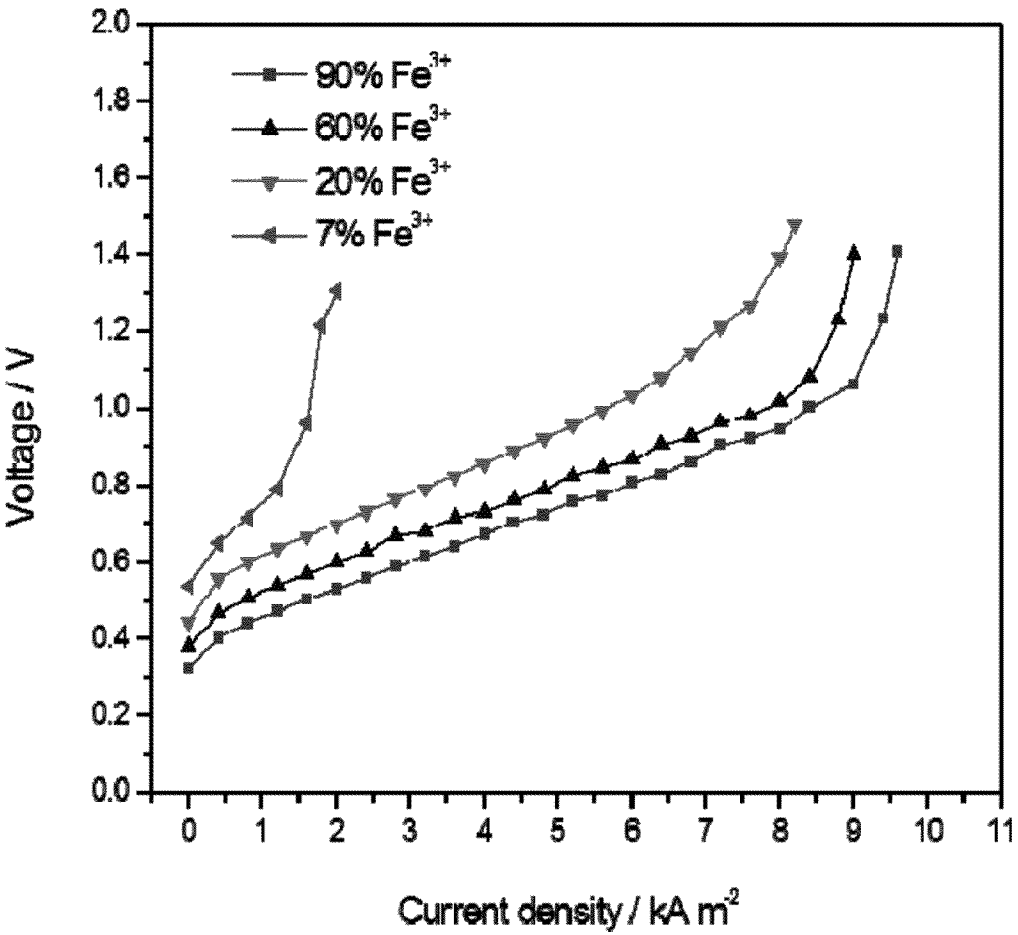
FIG. 13 is a graph of the voltage versus current density for different Fe(III):Fe(II) ratios of 90% $Fe^{3+}$ (■), 60% $Fe^{3+}$ (▲), 20% $Fe^{3+}$ (▼), 7% $Fe^{3+}$ (◀), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Nafion 212, Pt/C (0.6 mg Pt/cm$^2$) and PTFE (36 wt. %) in the anode, graphite felt in the cathode.
Figure 14:
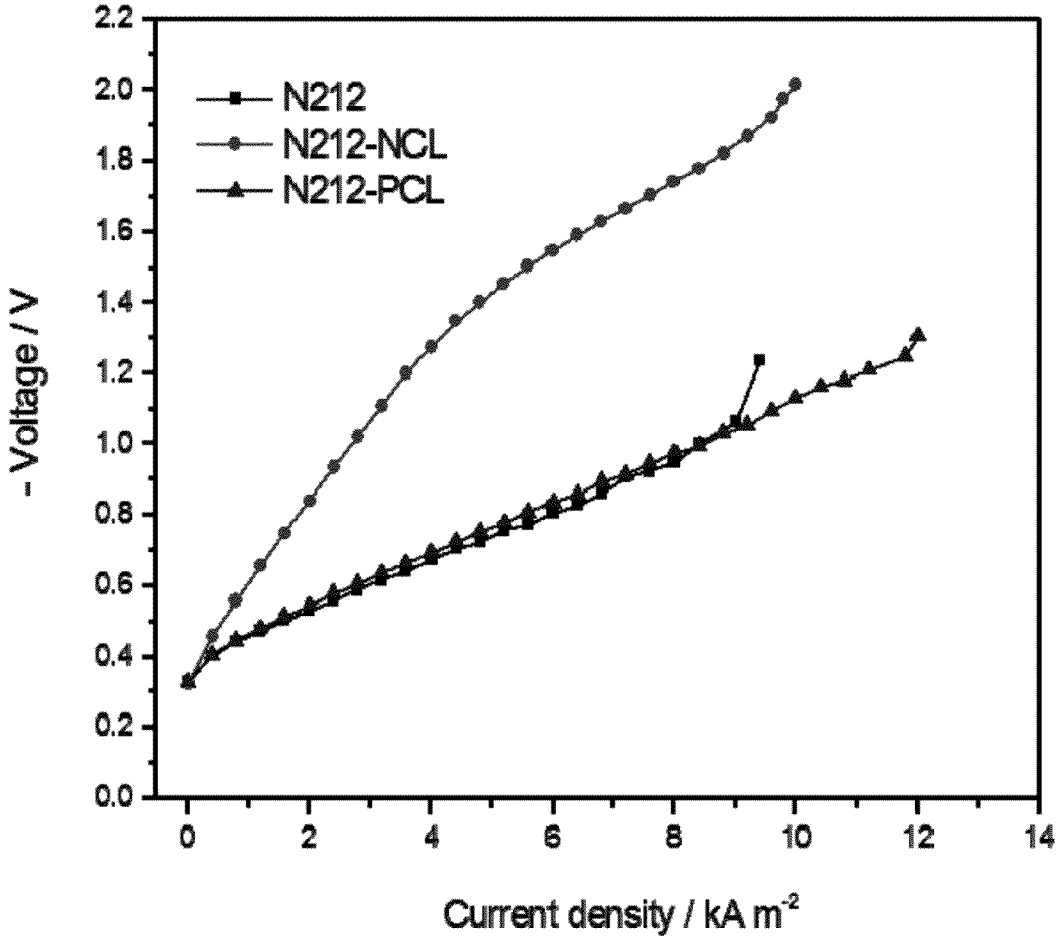
FIG. 14 is a graph of the voltage versus current density with polarization of cells with Nafion 212 membranes such that N212 was without a carbon layer (■); N212-NCL was with a carbon layer in the negative (●); and N212 was with a carbon layer in the positive (▲), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Nafion 212, Pt/C (0.6 mg Pt/cm$^2$) and PTFE (36 wt. %) in the anode, and a carbon layer (0.5 mg C/cm$^2$) and 20 wt. % Nafion in the cathode.
Figure 15:
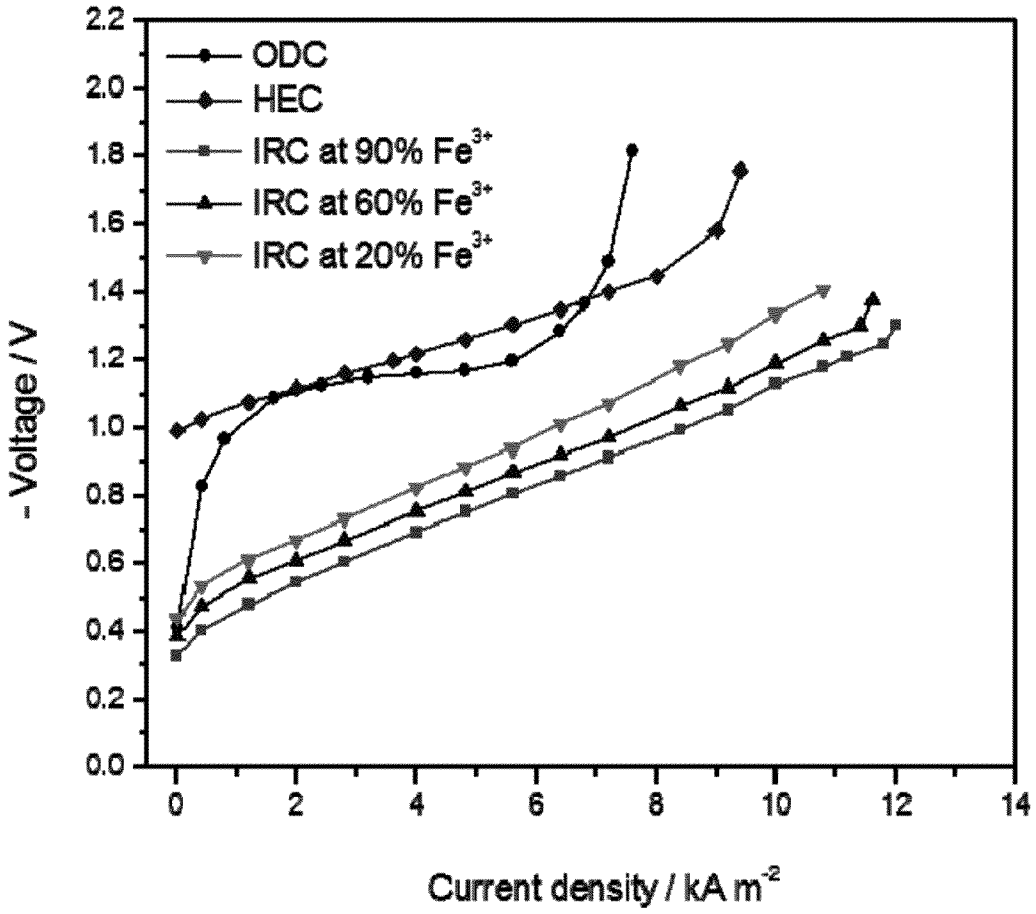
FIG. 15 is a graph of the voltage versus current density with polarization of cells with Nafion 212 and carbon layer in the positive at various $Fe^{3+}$ ratios (IRC at 90% $Fe^{3+}$ (■), IRC at 60% $Fe^{3+}$ (▲), IRC at 20% $Fe^{3+}$ (▼)) as well as comparative ODC (●) and hydrogen evolution cathode (HEC) (♦), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Pt/C (0.6 mg Pt/cm$^2$), PTFE (36 wt. %), carbon layer (0.5 mg C/cm$^2$) and 20 wt. % Nafion in the anode; Nafion 212 in the cathode.
Figure 16:
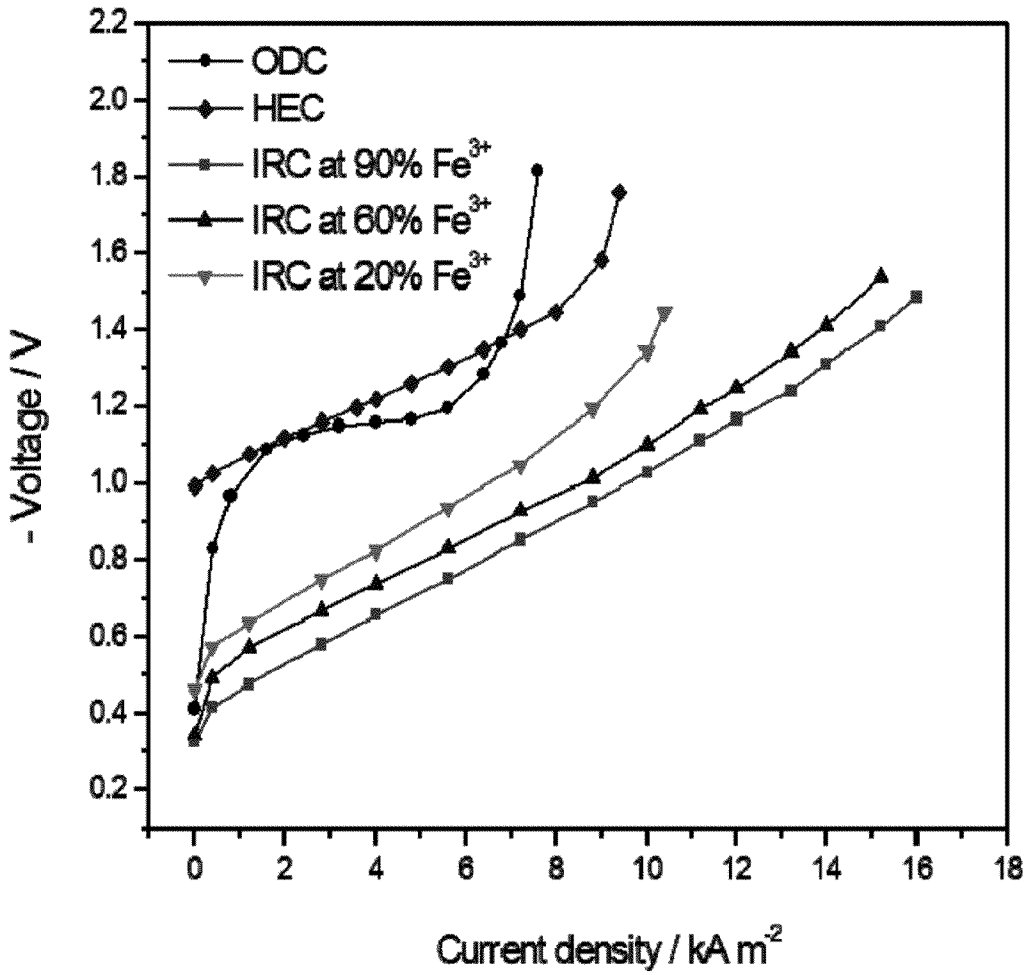
FIG. 16 is a graph of the voltage versus current density with polarization of cells with Nafion/PTFE and carbon layer in the positive at various $Fe^{3+}$ ratios (IRC at 90% $Fe^{3+}$ (■), IRC at 60% $Fe^{3+}$ (▲), IRC at 20% $Fe^{3+}$ (▼)) as well as comparative ODC (●) and HEC (♦), wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Pt/C (0.6 mg Pt/cm$^2$), PTFE (36 wt. %), carbon layer (0.5 mg C/cm$^2$) and 20 wt. % Nafion in the anode; Nafion/PTFE (13 microns in dry state) in the cathode.
Figure 17:
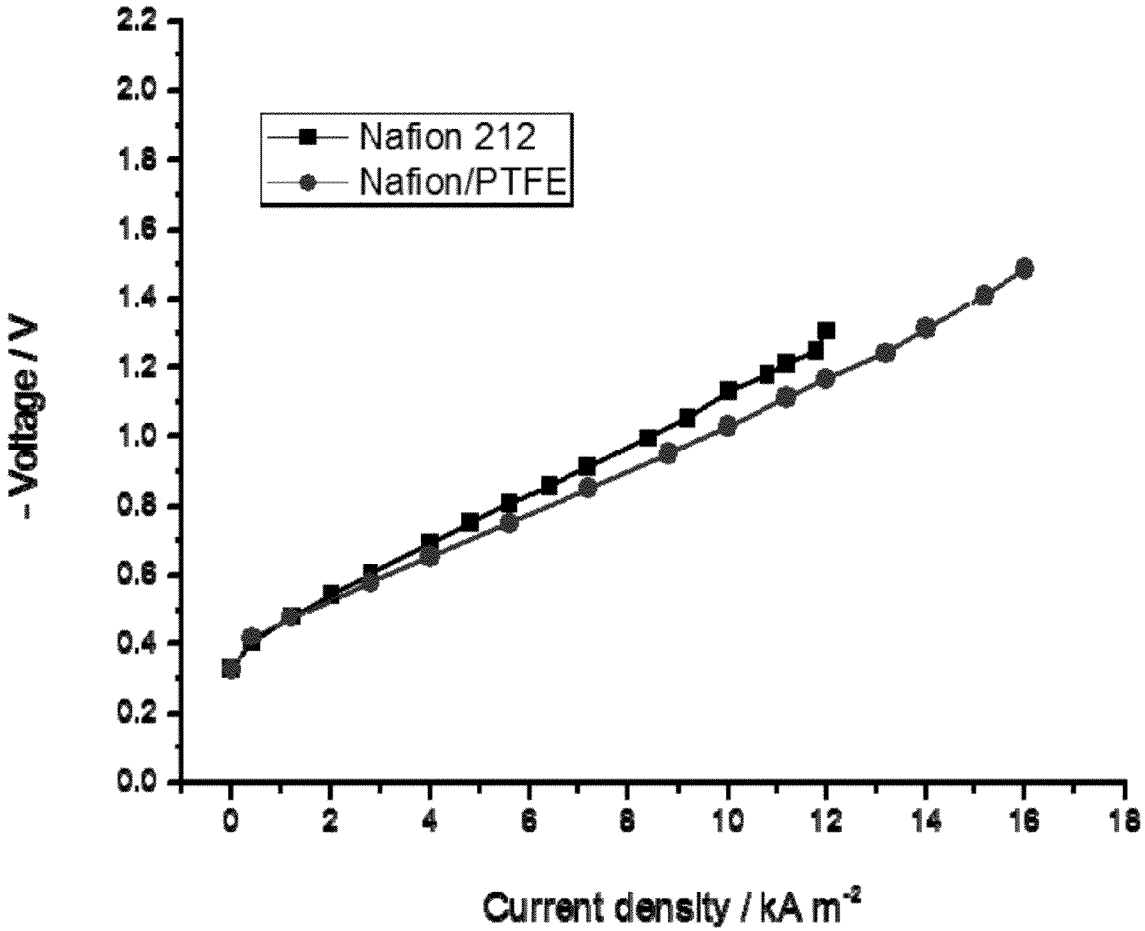
FIG. 17 is a graph of the voltage versus current density wherein the cell temperature is 40° C.; the anode had a gaseous HCl feed of 50 mL/min; the cathode had initial 1 M $FeCl_3$ and 4 M HCl mixture of 200 mL/min; the membrane electrode assembly (MEA) was Pt/C (0.6 mg Pt/cm$^2$), PTFE (36 wt. %), carbon layer (0.5 mg C/cm$^2$) and 20 wt. % Nafion in the anode; Nafion/PTFE at 90% $Fe^{3+}$ (●) or Nafion 212 (■) in the cathode.

FIG. 13 showed the performance of the electrolysis cell with a Nafion 212 membrane. The voltage was maintained at 0.673 to 0.857 V in the Fe(III) percent range of 90%-20% when the cell operated at the current density of 4 $kA/m^2$. Moreover, the cell with Nafion 212 operated at higher current density (up to 9 $kA/m^2$) as compared with the cell with Nafion 117 (up to 7 $kA/m^2$) at the same Fe(III)/Fe(II) (90/10) ratio before mass transport limitations come into effect.

Example 2

Membrane Electrode Assembly (MEA) Cells

For preparing the membrane electrode assembly (MEA), the anode electrode was prepared by spraying or spreading the homogeneous catalyst composition. Platinum on carbon (Pt/C) (60 wt. %, TKK) was used as the anode catalyst. The anode prepared by spraying had a homogeneous ink containing Pt/C (60 wt. %, TKK), a Nafion solution (5 wt. %, DuPont) and isopropanol and was sprayed onto the microporous layer (MPL) of a commercially available GDL (SGL25 BC, SGL Carbon Corp). The composition of the dry catalyst layers for the sprayed anode was 65 wt. % catalyst (Pt/C) and 35 wt. % Nafion. The platinum loading was 0.6 $mg/cm^2$. The anode prepared by spreading had a homogeneous ink containing Pt/C (60 wt. %, TKK), a PTFE emulsion and ethanol coated on the microporous layer (MPL) of a commercially available GDL (SGL25 BC, SGL Carbon Corp) using a blade. The anode was then calcined at 240° C. for 30 minutes and then at 340° C. for 30 minutes in $N_2$ to form the electrode. The composition of the dry catalyst layers for the spread anode was 64 wt. % catalyst (Pt/C) and 36 wt. % PTFE. The platinum loading was 0.6 $mg/cm^2$. The cathode electrode used untreated graphite felt (KFA-5, SGL Carbon Corp) or treated graphite felt. Treated graphite felt was performed via thermal oxidation at 500° C. in air for 5 hours. A hydrophobic carbon layer was introduced between the Nafion membrane and the anode catalyst layer by coating on Nafion membrane surface via spraying the homogenous ink containing carbon particle (VULCAN®XC72), Nafion solution (5 wt. %, DuPont) and isopropanol. The composition of the dry hydrophobic carbon layer is 80 wt. % C and 20 wt. % Nafion. The carbon loading was 0.5 $mg/cm^2$. The anode electrode, Nafion membrane with the hydrophobic carbon layer, and cathode electrode were assembled to form the membrane electrode assembly (MEA) for the IRC electrolysis cell.

A 5 $cm^2$ cell with graphite current collectors was used for all experiments (Fuel Cell Technologies). Dry hydrogen chloride gas was supplied to the positive electrode at 50 mL/minute through a rotameter. An aqueous catholyte solution was prepared by mixing iron chloride and hydrochloric acid. The catholyte solution was magnetically stirred and supplied to the negative electrode at 200 mL/minute by a peristaltic pump. The electrolysis cell was operated at 40° C. and atmospheric pressure. The electrochemical measurements were performed with a power supply (BK9171, BK Precision). Voltage-current curves (U-I curve) were recorded through increasing the current density at different Fe(III)/Fe(II) ratios conditions. The different Fe(III)/Fe(II) ratios were checked at a given time interval and determined with permanganate titration of the solution. EIS was carried out by a Solartron 1287 Electrochemical Interface in conjunction with a Solartron 1260 Frequency Response Analyzer at frequencies from 1 Hz to 100 kHz at the open circuit condition.

FIGS. 14-17 show graphs of the voltage versus the current density for the electrolysis cells containing MEAs in which a hydrophobic carbon layer was introduced either between the Nafion membrane and the cathode catalyst layer or between the Nafion membrane and the anode catalyst layer. The effects of different membranes were also shown. The results showed that cells with carbon layer in the anode enhanced current density before mass transport limitations came into effect. It is believed that the hydrophobicity of the carbon layer was helpful in blocking the permeation of water and the iron species from the cathode to the anode and thus improved the cell performance. When the carbon layer was added to the cathode, it blocked the permeation of water and iron species but it also blocked the permeation of protons and thus the performance decreased.

The hydrophobicity of carbon layer surface can be improved to enhance the blocking effects. For the cell with Nafion® 212 and a carbon layer on the anode, the voltage was maintained at 1.132 to 1.339 V in the Fe(III) percent range of 90%-20% when the cell operated at the current density of 10 $kA/m^2$. The cell with a thin Nafion®/PTFE composite membrane showed better performance than Nafion® 212 because the thin composite membrane decreases the cell internal resistance. With this thin composite membrane, the voltage was maintained at 1.029 to 1.345 V in the Fe(III) percent range of 90%-20% when the cell operated at the current density of 10 $kA/m^2$.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above devices and methods without departing from the scope of the invention, it is intended that all matter contained in the above description and shown in the accompanying drawings shall be interpreted as illustrative and not in a limiting sense.

What is claimed is:

1. An electrolysis system for producing chlorine gas comprising:

a cathode system comprising:

a cathode comprising an electron conductor;

a cathode electrolyte comprising Fe(II) compounds and Fe(III) compounds in contact with the electron conductor; and a reactor comprising a reactor solution, the reactor solution comprising an oxidant in fluid contact with the cathode electrolyte and at least 1 M hydrochloric acid;

wherein the fluid contact of the reactor solution with the cathode electrolyte allows the cathode electrolyte rich in Fe(II) compounds to be transferred to the reactor and combined with the reactor solution and the reactor solution rich in Fe(III) compounds to be transferred from the reactor to the cathode electrolyte after the oxidant of the reactor solution reacts with the electrolyte rich in Fe(II) compounds to form the reactor solution rich in Fe(III) compound an anode for oxidizing hydrogen chloride gas to form chlorine gas, the anode comprising an electron conductor, a catalyst layer, and a hydrophobic layer; and a membrane adjacent to the anode and to the cathode, the hydrophobic layer being between the membrane and the catalyst layer.

2. The electrolysis system of claim 1 wherein the cathode electrolyte and reactor solution are aqueous.

3. The electrolysis system of claim 1 wherein the electron conductor of the cathode comprises a porous carbon material, the electron conductor of the cathode comprises carbon paper, graphite felt, carbon felt, carbon cloth, or a combination thereof, or the electron conductor of the cathode has been heat treated.

4. The electrolysis system of claim 1 wherein the cathode electrolyte further comprises Fe(III), Fe(II) compounds and hydrochloric acid wherein the ratio of Fe(III) compounds to Fe(II) compounds is from about 9:1 to about 1:9 and the cathode is free of precious metal.

5. The electrolysis system of claim 1 wherein the electron conductor of the anode comprises a porous carbon material and the porous carbon material comprises carbon paper, graphite felt, carbon felt, carbon cloth, or a combination thereof.

6. The electrolysis system of claim 1 wherein the catalyst layer comprises platinum, ruthenium, osmium, rhenium, rhodium, iridium, palladium, gold, titanium, zirconium, or an oxide, an alloy, or mixture thereof, or the catalyst comprises metals supported on a carbon particle, a carbon nanotube, a graphene, or a combination thereof.

7. The electrolysis system of claim 1 wherein the catalyst layer further comprises a polymer binder.

8. The electrolysis system of claim 7 wherein the binder is sulfonated tetrafluoroethylene copolymer, polytetrafluoroethylene (PTFE), polyvinylidene difluoride (PVDF), or a combination thereof.

9. The electrolysis system of claim 1 wherein the membrane is a cation exchange membrane, an anion exchange membrane, or a porous membrane.

10. The electrolysis system of claim 1 wherein the electron conductor of the anode is between the catalyst layer and a current collector, and the cathode further comprises a current collector adjacent the electron conductor of the cathode.

11. The electrolysis system of claim 10 wherein the current collector comprises a graphite plate or a bipolar plate.

12. A method of generating chlorine gas using the electrolysis system of claim 1 comprising reducing Fe(III) compounds to Fe(II) compounds at the cathode;

oxidizing the Fe(II) compounds with oxygen gas or air in the reactor to form Fe(III) compounds and water; and contacting the Fe(III) compounds from the reactor with the cathode.

13. The method of claim 12 wherein the reactor comprises an inlet for the oxygen gas or air at a bottom portion of the reactor, an outlet for an oxygen-containing stream at an upper portion of the reactor, an inlet for Fe(II) compounds at the top portion of the reactor, an outlet for Fe(III) compounds at the bottom portion of the reactor, a condenser for receiving the oxygen-containing stream to recover oxygen gas and an aqueous condensate, and a recycle stream for returning the oxygen gas from the condenser to the reactor.

14. The method of claim 12 wherein the reactor is a bubble column reactor, a packed column, or a plate column.

15. The electrolysis system of claim 1 wherein the hydrophobic layer comprises carbon, sulfonated tetrafluoroethylene based fluoropolymer-copolymer, or a combination thereof.

16. The electrolysis system of claim 1 wherein the reactor solution comprises at least 4 M hydrochloric acid.

17. The electrolysis system of claim 16 wherein the hydrophobic layer comprises carbon.

18. The electrolysis system of claim 1, wherein the cathode system further comprises a first fluid line and a second fluid line in fluid contact with the cathode electrolyte and the reactor solution.

19. The electrolysis system of claim 18 wherein the first fluid line and the second fluid line are connected to a fluid pump.

20. The electrolysis system of claim 1 wherein the cathode electrolyte further comprises Fe(III), Fe(II) compounds and hydrochloric acid wherein the ratio of Fe(III) compounds to Fe(II) compounds is from about 95:5 to about 85:15.

21. The electrolysis system of claim 1 wherein the cathode is free of precious metal.

* * * * *